US008189020B2

(12) United States Patent
Koroishi et al.

(10) Patent No.: US 8,189,020 B2
(45) Date of Patent: May 29, 2012

(54) THERMAL HEAD, THERMAL PRINTER, AND MANUFACTURING METHOD FOR THERMAL HEAD

(75) Inventors: Keitaro Koroishi, Chiba (JP); Noriyoshi Shoji, Chiba (JP); Toshimitsu Morooka, Chiba (JP); Norimitsu Sanbongi, Chiba (JP); Yoshinori Sato, Chiba (JP)

(73) Assignee: Seiko Instruments Inc., Chiba (JP)

( * ) Notice: Subject to any disclaimer, the term of this patent is extended or adjusted under 35 U.S.C. 154(b) by 308 days.

(21) Appl. No.: 12/613,849

(22) Filed: Nov. 6, 2009

(65) Prior Publication Data

US 2010/0134582 A1 Jun. 3, 2010

(30) Foreign Application Priority Data

Nov. 28, 2008 (JP) ..... 2008-304370

(51) Int. Cl.
*B41J 2/335* (2006.01)

(52) U.S. Cl. ..... 347/204; 347/200

(58) Field of Classification Search ..... 347/200, 347/205, 206, 208, 209, 47, 204
See application file for complete search history.

(56) References Cited

U.S. PATENT DOCUMENTS

2007/0091161 A1* 4/2007 Shoji et al. ..... 347/200
2010/0013891 A1* 1/2010 Matsuo ..... 347/47

FOREIGN PATENT DOCUMENTS

JP 2007-083532 A 4/2007

* cited by examiner

*Primary Examiner* — Kristal Feggins
(74) *Attorney, Agent, or Firm* — Brinks Hofer Gilson & Lione

(57) ABSTRACT

To improve heat generating efficiency and printing quality, a plurality of heating resistors (14) are arranged with spaces therebetween on a heat storage layer (13) laminated on a surface of a supporting substrate (11) via an adhesive layer (12) made of an elastic material. A cavity section (19) is formed at a region between the supporting substrate (11) and the heat storage layer (13), the region being opposed to a heat generating portion of each of the plurality of heating resistors (14). The cavity section (19) includes a concave portion (20) formed in the surface of the supporting substrate (11) and the heat storage layer (13) in which the concave portion (20) is closed and the surface thereof is exposed to the cavity section (19).

7 Claims, 13 Drawing Sheets

THERMAL HEAD, THERMAL PRINTER, AND MANUFACTURING METHOD FOR THERMAL HEAD

RELATED APPLICATIONS

This application claims priority under 35 U.S.C. §119 to Japanese Patent Application No. JP2008-304370 filed on Nov. 28, 2008, the entire content of which is hereby incorporated by reference.

BACKGROUND OF THE INVENTION

1. Field of Invention

The present invention relates to a thermal head and a manufacturing method therefor, and a thermal printer, the thermal head being used in the thermal printer often mounted to a portable information equipment terminal typified by a compact hand-held terminal and being used to perform printing on a thermal recording medium based on printing data the aid of selective driving of a plurality of heating elements.

2. Description of Related Art

Recently, the thermal printers have been widely used in the portable information equipment terminals. The portable information equipment terminals are driven by a battery, which leads to strong demands for electric power saving of the thermal printers. Accordingly, there have been growing demands for thermal heads having high heat generating efficiency.

As a thermal head having high heat generating efficiency, one which has a structure disclosed, for example, in Japanese Patent Application Laid-Open No. 2007-83532 is known.

However, in the thermal head disclosed in FIG. 3 of Japanese Patent Application Laid-Open No. 2007-83532, a substrate (supporting substrate) and a heat storage layer are bonded to each other by anode bonding. Therefore, if a monocrystal silicon substrate having the thermal expansion coefficient of $3.3\times10^{-6}$ per degree centigrade is used as the substrate, and if soda glass that is inexpensive and has good workability but has the thermal expansion coefficient of $8.6\times10^{-6}$ per degree centigrade is used for the heat storage layer, a thermal expansion difference occurs between the substrate and the heat storage layer because of the temperature of a heating resistor that rises up to approximately 200 to 300 degrees centigrade when the thermal head is energized. As a result, a warpage or a distortion may occur in the thermal head so that the thermal head cannot contact correctly with thermal recording paper, which may cause a deterioration in print quality.

In contrast, if a monocrystal silicon substrate having the thermal expansion coefficient of $3.3\times10^{-6}$ per degree centigrade is used as the substrate, and if Pyrex glass that is expensive and has bad workability but has the thermal expansion coefficient of $3.2\times10^{-6}$ per degree centigrade is used for the heat storage layer, a warpage or a distortion does not occur in the thermal head. However, there are problems that manufacturing cost increases and that manufacturing steps are complicated.

On the other hand, the thermal head disclosed in FIG. 4 of Japanese Patent Application Laid-Open No. 2007-83532 includes the substrate and the heat storage layer bonded to each other via an adhesive layer (bonding layer), and forms an cavity section. However, in order to improve heat generating efficiency by the cavity section, it is preferred that depth (height) of the cavity section be 50 μm or larger. It is difficult to form the cavity section having a height of 50 μm or larger only by the adhesive layer.

SUMMARY OF THE INVENTION

The present invention has been made to solve the problems described above, and it is an object of the invention to provide a thermal head, which can improve heat generating efficiency and print quality.

In order to solve the problems described above, the present invention adopts the following means.

In a thermal head according the present invention, a plurality of heating resistors are arranged with spaces therebetween on a heat storage layer laminated on a surface of a supporting substrate via an adhesive layer made of an elastic material. A cavity section is formed at a region between the supporting substrate and the heat storage layer, the region being opposed to a heat generating portion of each of the plurality of heating resistors. The cavity section includes a concave portion formed in the surface of the supporting substrate and the heat storage layer in which the concave portion is closed and the surface thereof is exposed to the cavity section.

According to the thermal head of the present invention, the thermal expansion difference that occurs between the supporting substrate and the heat storage layer because of the temperature of the heating resistors that rises up to approximately 200 to 300 degrees centigrade when the thermal head is energized is absorbed by elastic deformation of the adhesive layer made of an elastic material. Therefore, a warpage or a distortion is eliminated (or reduced) when the thermal head is energized, and hence the print quality can be maintained to be always in an optimal condition.

In addition, even if a monocrystal silicon substrate is adopted as a material of the supporting substrate, soda glass that is inexpensive and has good workability can be adopted as a material of the heat storage layer. Therefore, manufacturing cost can be reduced and manufacturing steps can be simplified.

Further, beneath the region opposed to a heat generating portion of each of the plurality of heating resistors (region covered with the heat generating portion), there is formed a cavity portion having a sufficient depth (height) for improving the heat generating efficiency, that is, a heat insulating layer for restricting heat flowing into the supporting substrate from the heat storage layer. Therefore, the heat generating efficiency can be improved.

In the thermal head described above, it is preferred that a wall surface and a bottom surface which constitute the concave portion be exposed to the cavity section.

According to the thermal head described above, the adhesive layer is not laminated (formed) on the wall surface and the bottom surface of the concave portion. In other words, the adhesive layer is laminated (formed) at a region other than the region at which the concave portion is formed on the one surface of the supporting substrate, in which the concave portion is formed. Therefore, heat dissipation via the adhesive layer can be suppressed, and hence the heat generating efficiency can be further improved.

In the thermal head described above, it is more preferred that a dam be formed along the wall surface of the concave portion on one surface of the supporting substrate, and the adhesive layer be arranged outside the dam.

According to the thermal head described above, the adhesive layer having the thickness equal to the height of the dam is formed uniformly (evenly). Therefore, unevenness (variation) of thermal efficiency due to variation (difference) of thickness of the adhesive layer can be eliminated, and hence the print quality can be further improved.

In addition, a tip surface of the dam protruding from the one surface of the supporting substrate toward the another surface of the heat storage layer supports the pressing force exerted by the surface of the heating resistor. Therefore, mechanical strength against an excessive pressure when the printing is performed can be improved, and hence durability and reliability can be improved.

The thermal printer of the present invention is provided with a thermal head having high heat generating efficiency.

According to the thermal printer of the present invention, printing on thermal recording paper can be performed with small electric power, and hence duration time of a battery can be lengthened and reliability of the entire printer can be improved.

A manufacturing method for a thermal head according to the present invention includes: forming a concave portion in a surface of a supporting substrate; laminating an adhesive layer made of an elastic material on the surface of the supporting substrate, in which the concave portion is formed; bonding a heat storage layer in a laminated state with respect to the surface of the supporting substrate via the adhesive layer; and forming a plurality of heating resistors with spaces therebetween at a region corresponding to a surface of the heat storage layer, the region being opposed to the concave portion.

According to the manufacturing method for the thermal head of the present invention, even if a monocrystal silicon substrate is adopted as a material of the supporting substrate, soda glass that is inexpensive and has good workability can be adopted as a material of the heat storage layer. Therefore, manufacturing cost can be reduced and manufacturing steps can be simplified.

In addition, beneath the region opposed to a heat generating portion of each of the plurality of heating resistors (region covered with the heat generating portion), there is formed the cavity section having a sufficient depth (height) for improving the heat generating efficiency, that is, a heat insulating layer for restricting heat flowing into the supporting substrate from the heat storage layer. Therefore, the heat generating efficiency can be improved.

The manufacturing method for the thermal head described above, it is more preferred that laminating the adhesive layer include laminating an adhesive layer material formed in a flat sheet-like shape on the surface of the supporting substrate, and then deforming the adhesive layer material by one of heat and external force so as to conform to a shape of the surface of the supporting substrate, in which the concave portion is formed.

According to the manufacturing method for the thermal head described above, it is possible to use the adhesive layer material that can be easily manufactured to have a flat sheet-like shape. Therefore, manufacturing cost can be reduced and manufacturing steps can be simplified.

The manufacturing method for the thermal head described above, it is more preferred that laminating the adhesive layer include laminating the adhesive layer at a region other than the concave portion on the surface of the supporting substrate, in which the concave portion is formed.

According to the manufacturing method for the thermal head described above, the adhesive layer is not laminated (formed) on the wall surface and the bottom surface of the concave portion. In other words, the adhesive layer is laminated (formed) at a region other than the region at which the concave portion is formed on the one surface of the supporting substrate, in which the concave portion is formed. Therefore, heat dissipation via the adhesive layer can be suppressed, and hence the heat generating efficiency can be further improved.

A manufacturing method for a thermal head according to the present invention includes: forming a concave portion and a dam surrounding the concave portion on a surface of a supporting substrate; laminating an adhesive layer made of an elastic material at a region outside the dam on the supporting substrate in which the concave portion and the dam are formed; bonding a heat storage layer in a laminated state with respect to the surface of the supporting substrate via the adhesive layer; and forming a plurality of heating resistors with spaces therebetween at a region corresponding to a surface of the heat storage layer, the region being opposed to the concave portion.

A manufacturing method for a thermal head according to the present invention includes: forming a concave portion and a dam surrounding the concave portion on a surface of a supporting substrate; laminating a heat storage layer on the surface of the supporting substrate in which the concave portion and the dam are formed, injecting an adhesive layer material made of an elastic material into a gap formed between the heat storage layer and the supporting substrate by the dam; and bonding the supporting substrate and the heat storage layer to each other.

According to these manufacturing methods for the thermal head of the present invention, the adhesive layer that is apt to flow into the cavity section from between the tip surface of the dam and the another surface of the heat storage layer is blocked by the dam. Therefore, the adhesive layer is prevented from adhering to the portion between the tip surface of the dam and the another surface of the heat storage layer or to the wall surface or the bottom surface of the concave portion. Thus, heat dissipation via the adhesive layer can be suppressed, and hence the heat generating efficiency can be further improved.

In addition, even if a monocrystal silicon substrate is adopted as a material of the supporting substrate, soda glass that is inexpensive and has good workability can be adopted as a material of the heat storage layer. Therefore, manufacturing cost can be reduced and manufacturing steps can be simplified.

In addition, beneath the region opposed to a heat generating portion of each of the plurality of heating resistors (region covered with the heat generating portion), there is formed the cavity section having a sufficient depth (height) for improving the heat generating efficiency, that is, a heat insulating layer for restricting heat flowing into the supporting substrate from the heat storage layer. Therefore, the heat generating efficiency can be improved.

According to the present invention, it is possible to provide the effect of improving the heat generating efficiency the printing quality.

DETAILED DESCRIPTION OF THE PREFERRED EMBODIMENTS

Hereinafter, description is made of a first embodiment of a thermal head according to the present invention with reference to FIGS. 1 to 10.

Figure 1:
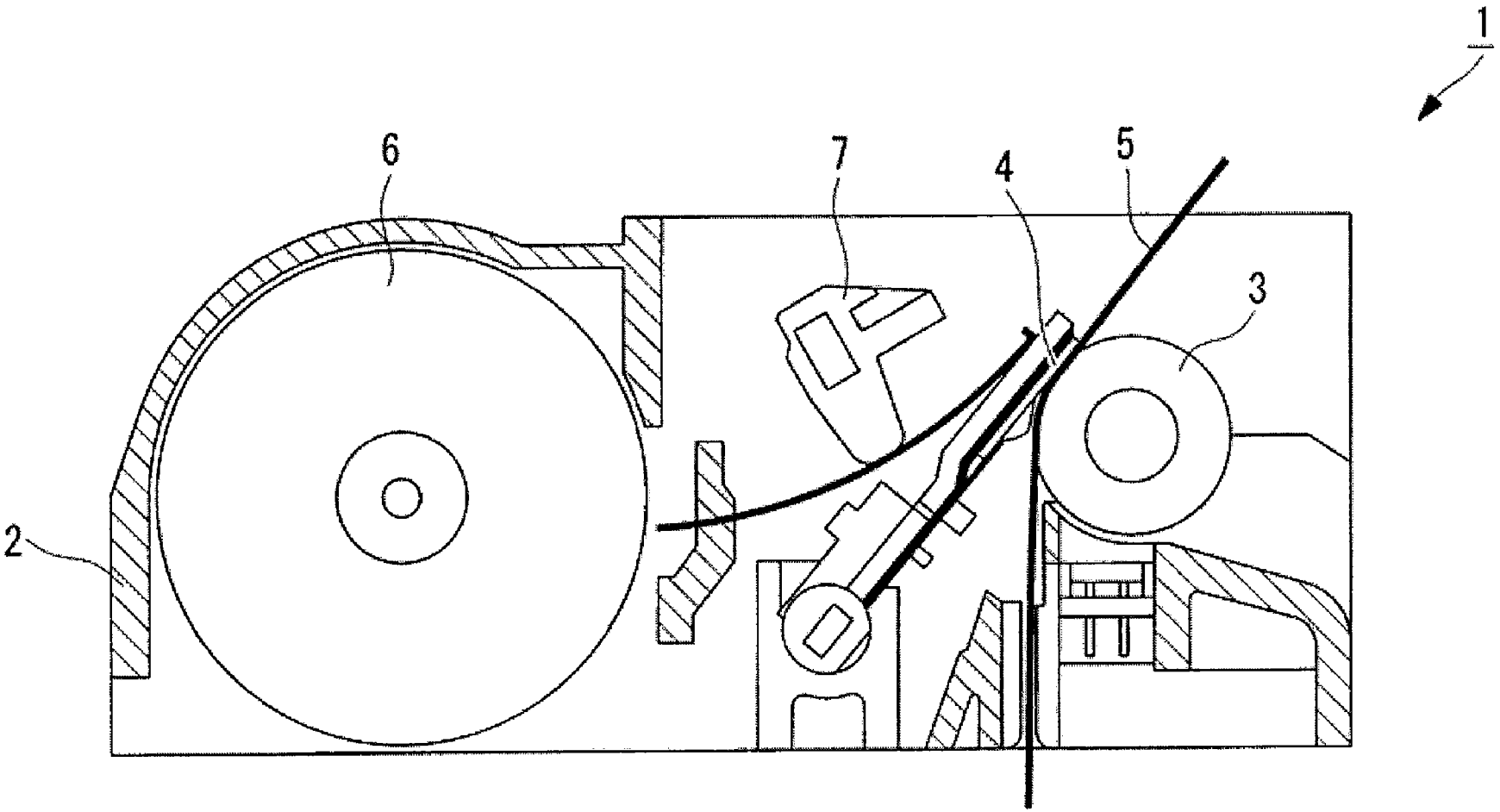
FIG. 1 is a longitudinal sectional view of a thermal printer provided with a thermal head according to the present invention.
Figure 2:
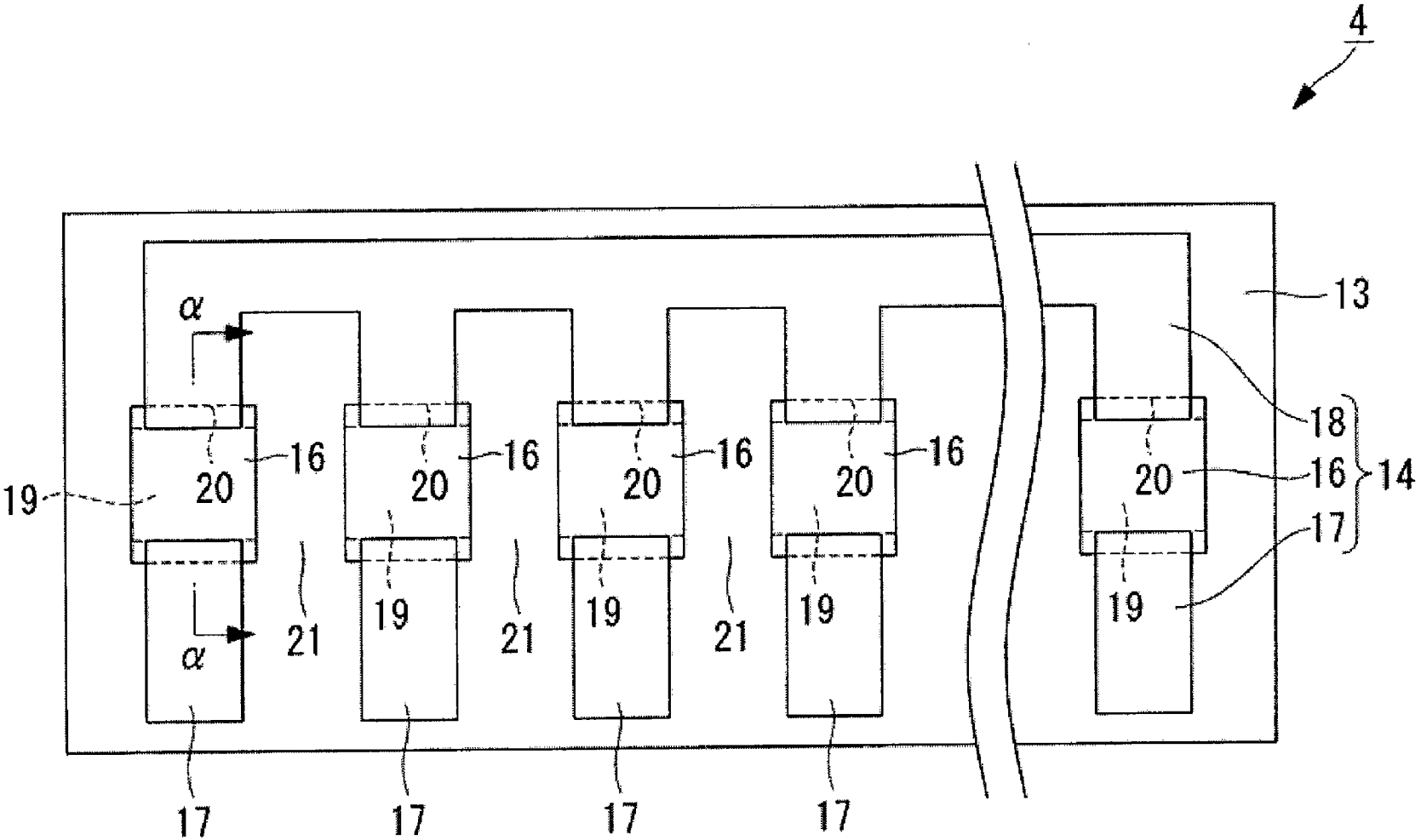
FIG. 2 is a plan view of a thermal head according to a first embodiment of the present invention, illustrating a state without a protective film.
Figure 3:
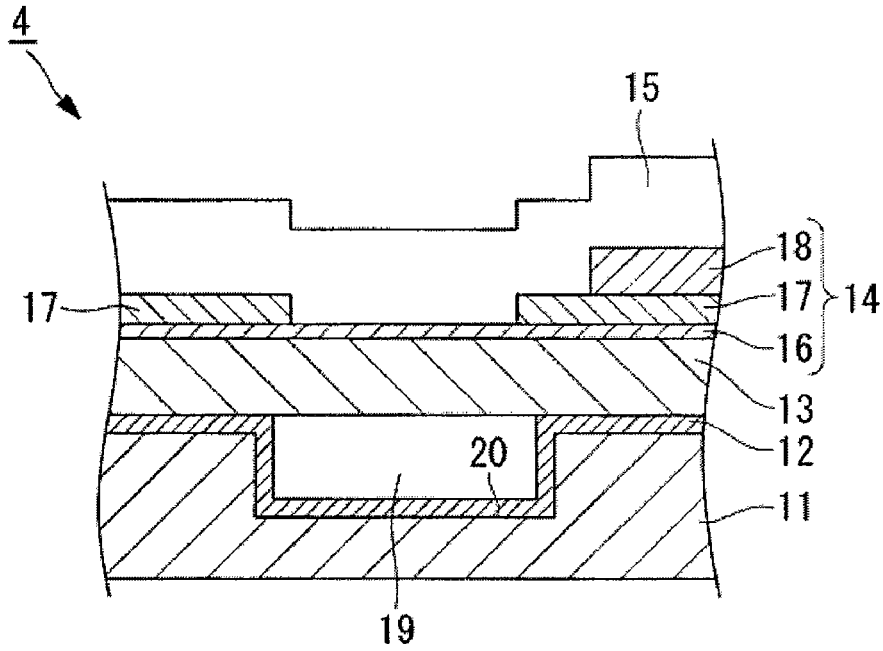
FIG. 3 is a cross sectional view taken along the arrow α-α in FIG. 2.

FIG. 1 is a longitudinal sectional view of a thermal printer provided with the thermal head of the present invention. FIG. 2 is a plan view of the thermal head according to this embodiment, which illustrates a state of eliminating a protective film. FIG. 3 is a sectional view taken along the arrow α-α of FIG. 2. FIGS. 4 to 10 are process diagrams for illustrating a manufacturing method for the thermal head according to this embodiment.

As illustrated in FIG. 1, a thermal printer 1 includes a main body frame 2, a platen roller 3 horizontally arranged, a thermal head 4 arranged oppositely to an outer peripheral surface of the platen roller 3, a paper feeding mechanism 6 for feeding out thermal recording paper 5 between the platen roller 3 and the thermal head 4, and a pressure mechanism 7 for pressing the thermal head 4 against the thermal recording paper 5 by a predetermined pressing force.

As illustrated in FIG. 2 or 3, the thermal head 4 includes a supporting substrate (hereinafter referred to as a "substrate") 11, an adhesive layer 12 made of an elastic material (or an elastic material layer or a stress relaxation layer) that is formed in a predetermined pattern on one surface of the substrate 11 (upper surface in FIG. 3) of a heat storage layer 13, and the heat storage layer 13 that is bonded to the substrate 11 via the adhesive layer 12. In addition, the one surface (upper surface in FIG. 3) of the heat storage layer 13 is provided with a plurality of heating resistors 14 that are formed (arranged) with spaces therebetween in one direction. Further, as illustrated in FIG. 3, the thermal head 4 includes a protective film 15 for covering the one surface (upper surface in FIG. 3) of the heat storage layer 13 and the heating resistor 14 so as to protect the same from abrasion and corrosion.

Note that, on another surface (lower surface in FIG. 3) of the substrate 11, there is provided a heat dissipation plate (not shown).

Each of the heating resistors 14 includes a heating resistor layer 16 formed on one surface of the heat storage layer 13 in a predetermined pattern, an individual electrode 17 formed on the one surface (upper surface in FIG. 3) of the heating resistor layer 16 in a predetermined pattern, and a common electrode 18 formed on one surface (upper surface in FIG. 3) of the individual electrode 17 in a predetermined pattern.

Note that, an actually heat generating portion of each of the plurality of the heating resistors 14 (hereinafter, referred to as "heat generating portion") is a portion not overlapped with the individual electrode 17 and the common electrode 18.

As illustrated in FIGS. 2 and 3, a concave portion 20 for forming cavity portions (hollow heat insulating layers) 19 is formed on the surface (upper surface in FIG. 3) of the substrate 11.

A concave portion 20 is provided so as to form a cavity portion 19 for each of the heating resistors 14. The concave portion 20 and the concave portion 20 are separated (comparted) by an interdot partition 21 (see FIG. 2). In addition, a plurality of concave portions 20 are formed on the surface of the substrate 11, and hence the entire surface of the interdot partition 21 between the concave portion 20 and the concave portion 20 contacts with the back surface of the heat storage layer 13 via the adhesive layer 12.

Each of the cavity portions 19 is a space formed beneath a region opposed to the heat generating portion of each of the plurality of the heating resistors 14 (region covered with the heat generating portion), that is, a space formed (enclosed) by the another surface (lower surface in FIG. 3) of the heat storage layer 13, wall surfaces of adhesive layer 12 (surfaces orthogonal to the one surface of the substrate 11 and the another surface of the heat storage layer 13), and bottom surface (surface horizontal to the one surface of the substrate 11 and the another surface of the heat storage layer 13). Further, a space layer in each of the cavity portions 19 functions as a insulating layer for regulating heat flowing into the substrate 11 from the heat storage layer 13.

Note that, the cavity portion 19 can have any size in a plan view. The cavity portion 19 may be larger than the heat generating portion like this embodiment or may be smaller than the heat generating portion, as long as the size thereof is close to the size of the heat generating portion.

The adhesive layer 12 bonds the one surface of the substrate 11 to the another surface of the heat storage layer 13, and absorbs a thermal expansion difference (thermal extension difference) that occurs between the substrate 11 and the heat storage layer 13.

As a material for the adhesive layer 12, there is used a high heat-resistance material capable of withstanding a temperature of the heating resistors 14 that rises up to approximately from 200 to 300 degrees centigrade, for example, an organic resin material such as a polyimide resin, a polyamideimide resin, an epoxy resin, an acrylic resin, a silicone resin, or a fluororesin.

Next, description is made, with reference to FIGS. 4 to 10, of a manufacturing method for the thermal head 4 according to this embodiment.

Figure 4:
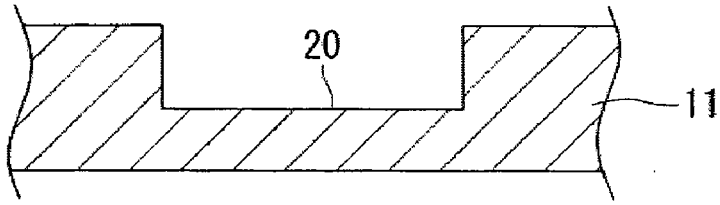
FIG. 4 is a process diagram for illustrating a manufacturing method for the thermal head according to the first embodiment of the present invention.

First, as illustrated in FIG. 4, the concave portion 20 is formed so as to provide the cavity portion 19 at the region opposed to a heat generating portion of each of the plurality of heating resistors 14 of the surface of the substrate 11 having a constant thickness (approximately 300 μm to 1 mm). Concerning material of the substrate 11, for example, a glass substrate, a monocrystal silicon substrate, or a ceramic substrate (alumina substrate) is used. The glass substrate is made of soda glass having the thermal expansion coefficient of $8.6\times10^{-6}$ per degree centigrade, Pyrex glass having the thermal expansion coefficient of $3.2\times10^{-6}$ per degree centigrade, no alkali glass having the thermal expansion coefficient of $3.8\times10^{-6}$ per degree centigrade, or the like. The monocrystal silicon substrate has the thermal expansion coefficient of $3.3\times10^{-6}$ per degree centigrade. The ceramic substrate has the thermal expansion coefficient of $7.2\times10^{-6}$ per degree centigrade.

The concave portion 20 is formed on the surface of the substrate 11 by sandblasting, dry etching, wet etching, laser processing, or the like.

Note that, in the case where the substrate 11 is processed by sandblasting, the surface of the substrate 11 is covered with a photoresist material, and the photoresist material is exposed to light using a photo mask having a predetermined pattern, to thereby solidify a portion other than a region in which the concave portions 20 are to be formed. Then, the surface of the substrate 11 is washed, and the photoresist material which is not solidified is removed, to thereby obtain an etching mask having etching windows formed in the region in which the concave portions 20 are to be formed. The surface of the substrate 11 is subjected to sandblasting in this state, and thus the concave portion 20 having a predetermined depth is obtained.

In the case where processing is performed through etching, the etching mask having the etching windows formed in the region in which the concave portions 20 are to be formed is formed on the surface of the substrate 11 in the same manner, and the surface of the substrate 11 is subjected to etching in this state, whereby the concave portion 20 having the predetermined depth is obtained. In the etching process, for example, wet etching is performed using an etching liquid such as a tetramethylammonium hydroxide solution, a KOH solution, or a mixed liquid of fluorinated acid and nitric acid in the case of the single-crystal silicon, and wet etching is performed using a fluorinated acid etching liquid or the like in the case of the glass substrate. In addition, dry etching such as reactive ion etching (RIE) or plasma etching is employed.

Figure 5:
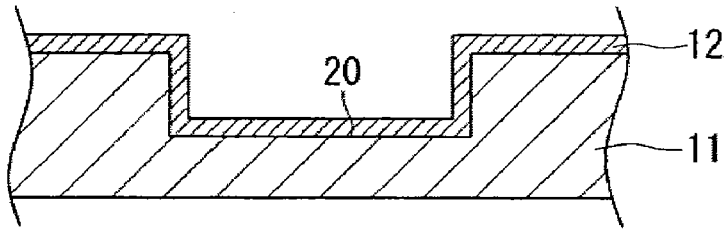
FIG. 5 is a process diagram for illustrating the manufacturing method for the thermal head according to the first embodiment of the present invention.

Next, the etching mask is removed completely from the surface of the substrate 11, and then the paste-like adhesive layer 12 is laminated (formed) on the entire of the one surface of the substrate 11 as illustrated in FIG. 5.

Figure 6:
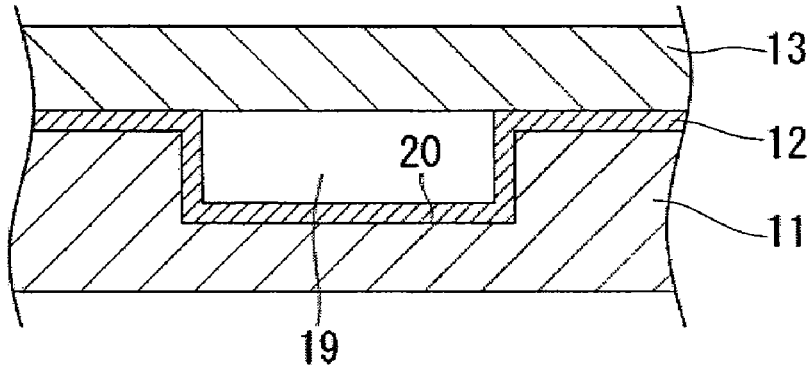
FIG. 6 is a process diagram for illustrating the manufacturing method for the thermal head according to the first embodiment of the present invention.
Figure 7:
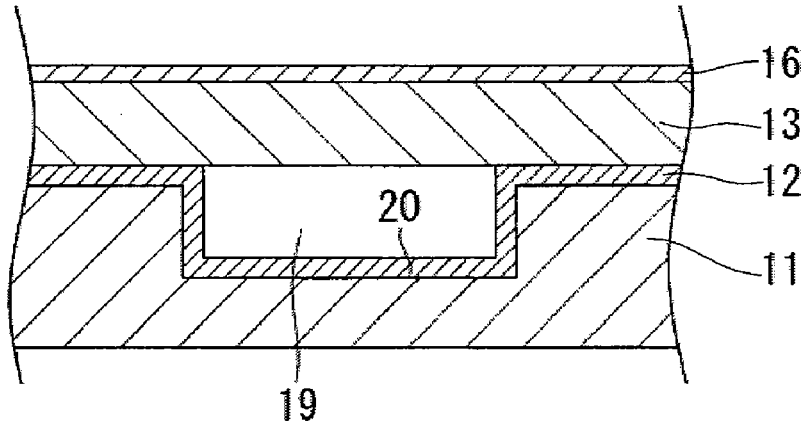
FIG. 7 is a process diagram for illustrating the manufacturing method for the thermal head according to the first embodiment of the present invention.
Figure 8:
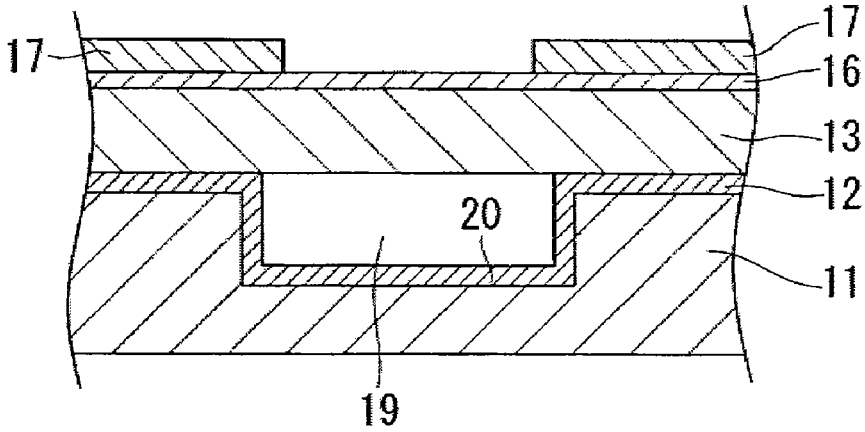
FIG. 8 is a process diagram for illustrating the manufacturing method for the thermal head according to the first embodiment of the present invention.
Figure 9:
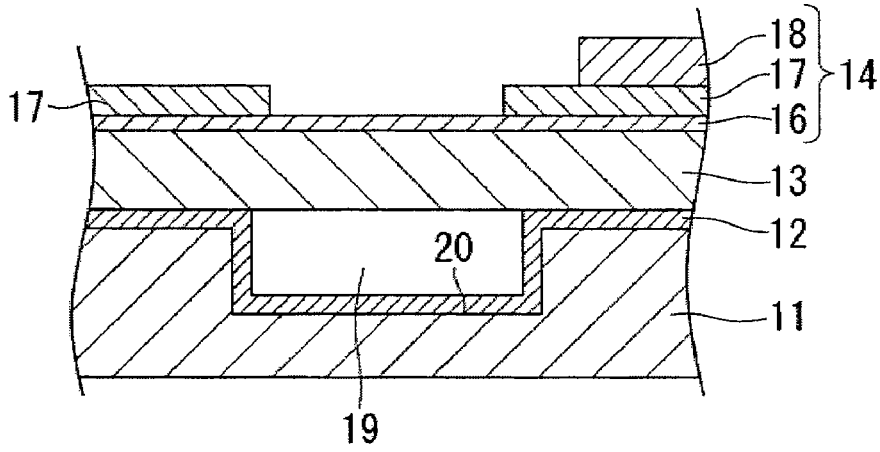
FIG. 9 is a process diagram for illustrating the manufacturing method for the thermal head according to the first embodiment of the present invention.
Figure 10:
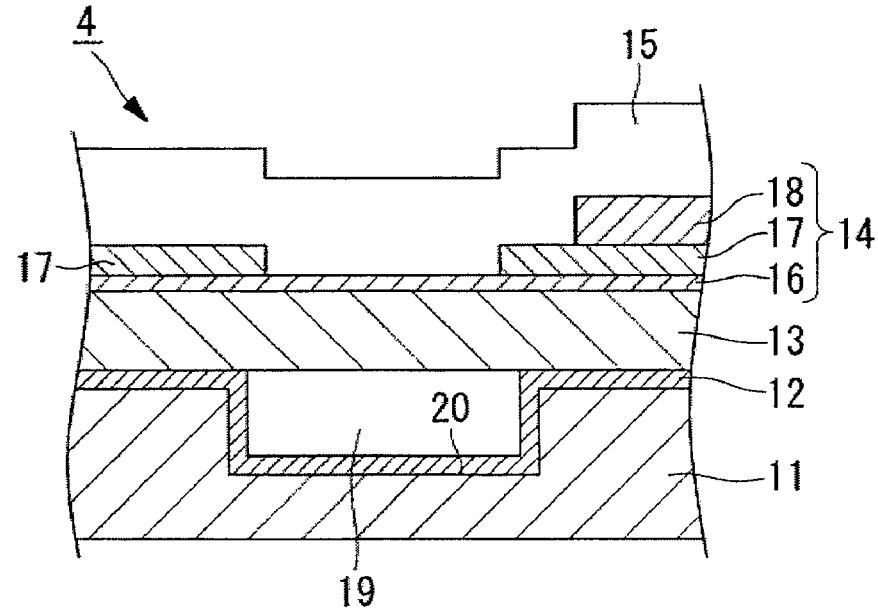
FIG. 10 is a process diagram for illustrating the manufacturing method for the thermal head according to the first embodiment of the present invention.

Next, as illustrated in FIG. 6, the heat storage layer 13 having a constant thickness (approximately 10 to 100 μm) is overlaid on one surface of the paste-like adhesive layer 12 (upper surface in FIG. 6), and a predetermined temperature and load are applied uniformly for a certain time period so that the substrate 11 and the heat storage layer 13 are bonded (glued) to each other. Concerning material of the heat storage layer 13, for example, a glass substrate is used, which is made of soda glass having the thermal expansion coefficient of $8.6\times10^{-6}$ per degree centigrade, Pyrex glass having the thermal expansion coefficient of $3.2\times10^{-6}$ per degree centigrade, no alkali glass having the thermal expansion coefficient of $3.8\times10^{-6}$ per degree centigrade, or the like.

Here, the heat storage layer 13 made of a thin glass substrate having a thickness of approximately 10 μm to 100 μm is difficult to manufacture or handle, and is expensive. Therefore, instead of bonding the above-mentioned heat storage layer 13 made of a thin glass substrate directly to the substrate 11, the heat storage layer 13 made of glass substrate having a thickness that is easy to manufacture or handle may be bonded to the substrate 11 and afterward the heat storage layer 13 may be processed to have a desired thickness by etching or polishing. In this case, the very thin heat storage layer 13 can be formed uniformly and inexpensively on the one surface of the substrate 11 with ease.

As the etching of the heat storage layer 13 made of a glass substrate, various types of etchings used for forming the concave portion 20 can be used. In addition, the heat storage layer 13 made of a glass substrate can be polished by chemical mechanical polishing (CMP) or the like, which is used for high accuracy polishing of a semiconductor wafer and the like.

Then, on the heat storage layer 13 formed as described above, the heating resistor layer 16 (see FIG. 7), individual electrodes 17 (see FIG. 8), a common electrode 18 (see FIG. 9), and the protective film 15 (see FIG. 10) are sequentially formed. Note that, the order of forming the heating resistor layer 16, the individual electrodes 17, and the common electrode 18 is arbitrary.

The heating resistor layer 16, the individual electrodes 17, the common electrode 18, and the protective film 15 can be manufactured by using a manufacturing method for those members of a conventional thermal head. Specifically, a thin film formation method such as sputtering, chemical vapor deposition (CVD), or vapor deposition is used to form a thin film made of a Ta-based or silicide-based heating resistor material on the heat storage layer 13. Then, the thin film made of the heating resistor material is molded by lift-off, etching, or the like, whereby the heating resistor having a desired shape is formed.

Similarly, the film formation with use of an electrode material such as Al, Al—Si, Au, Ag, Cu, and Pt is performed on the heat storage layer 13 by using sputtering, vapor deposition, or the like. Then, the film thus obtained is formed by lift-off or etching, or the electrode material is screen-printed and is burned thereafter, to thereby form the individual electrodes 17 and the common electrode 18 which have the desired shapes.

After the above-mentioned formation of the heating resistor layer 16, the individual electrodes 17, and the common electrode 18, the film formation with use of a protective film material such as $SiO_2$, $Ta_2O_5$, SiAlON, $Si_3N_4$, or diamond-like carbon is performed on the heat storage layer 13 by sputtering, ion plating, CVD, or the like, whereby the protective film 15 is formed.

According to the thermal head 4 of the present invention, the thermal expansion difference that occurs between the substrate 11 and the heat storage layer 13 because of the temperature of the heating resistor 14 that rises up to approximately 200 to 300 degrees centigrade when the thermal head 4 is energized is absorbed by elastic deformation of the adhesive layer 12 made of an elastic material. Therefore, a warpage or a distortion of the thermal head 4 is eliminated (or reduced) when the thermal head 4 is energized, and hence the print quality can be maintained to be always in an optimal condition.

Further, even if a monocrystal silicon substrate is adopted as a material of the substrate 11, soda glass that is inexpensive and has good workability can be adopted as a material of the heat storage layer 13. Therefore, manufacturing cost can be reduced and manufacturing steps can be simplified.

In addition, beneath the region opposed to a heat generating portion of each of the plurality of heating resistors 14 (region covered with the heat generating portion), there is formed the cavity portion 19 having a sufficient depth (height) for improving the heat generating efficiency, that is, a heat insulating layer for restricting heat flowing into the substrate 11 from the heat storage layer 13. Therefore, the heat generating efficiency can be improved.

Further, according to the thermal printer 1 provided with the thermal head 4 according to this embodiment, because the thermal head 4 having high heat generating efficiency is provided, it is possible to perform printing onto the thermal recording paper 5 with small electric power. Therefore, it is possible to lengthen a duration time of a battery.

On the other hand, according to the manufacturing method for the thermal head 4 according to this embodiment, even if a monocrystal silicon substrate is adopted as a material of the substrate 11, soda glass that is inexpensive and has good workability can be adopted as a material of the heat storage layer 13. Therefore, manufacturing cost can be reduced and manufacturing steps can be simplified.

In addition, beneath the region opposed to a heat generating portion of each of the plurality of heating resistors 14, there is formed the cavity section 19 having a depth sufficient for improving the heat generating efficiency, that is, the heat insulating layer for restricting heat flowing into the substrate 11 from the heat storage layer 13. Therefore, the heat generating efficiency can be improved.

Note that, the paste-like adhesive layer 12 can be laminated on the entire of the one surface of the substrate 11 by adopting the methods illustrated in FIGS. 11 to 16, for example.

Figure 11A:
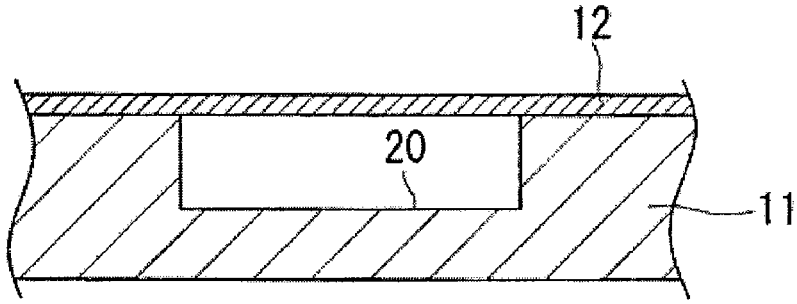
FIGS. 11A and 11B are process diagrams for illustrating the manufacturing method for the thermal head according to the first embodiment of the present invention.
Figure 11B:
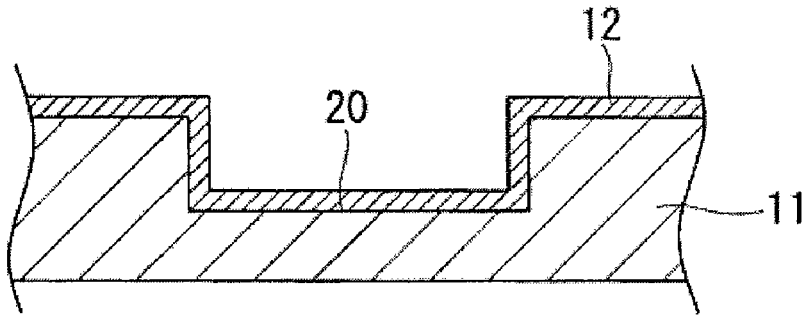

The method illustrated in FIGS. 11A and 11B includes overlaying (coating) the sheet-like adhesive layer 12 having a constant thickness (approximately 10 to 100 μm) on the one surface of the substrate 11 (see FIG. 4) in which the concave portion 20 is formed as illustrated in FIG. 11A, and pressing the adhesive layer 12 into the concave portion 20 with a soft roller, a rod, a die, or the like (not shown), and hence the entire of the one surface of the substrate 11 is covered with the adhesive layer 12.

According to this manufacturing method, it is possible to use an adhesive layer material that can be easily manufactured to have a flat sheet-like shape. Therefore, manufacturing cost can be reduced and manufacturing steps can be simplified.

Note that, the adhesive layer 12 becomes easy to press into when it is heated.

Figure 12A:
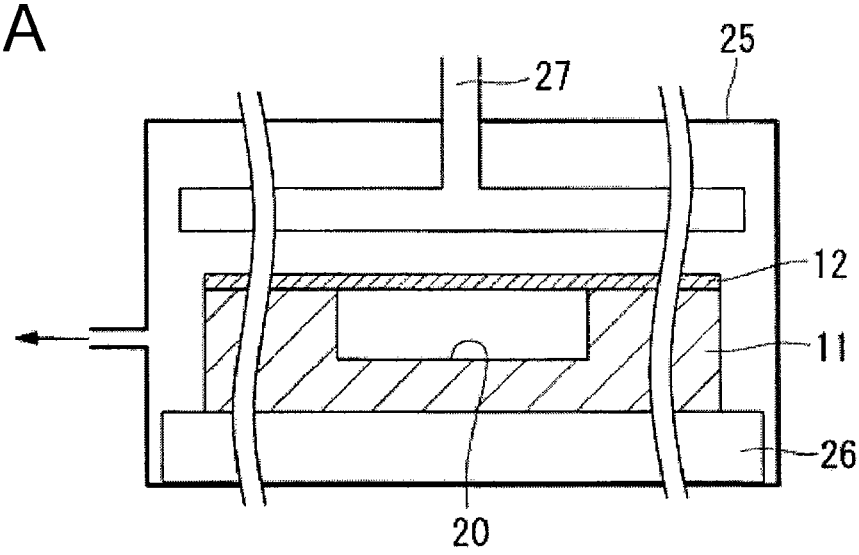
FIGS. 12A, 12B, and 12C are process diagrams for illustrating the manufacturing method for the thermal head according to the first embodiment of the present invention.
Figure 12B:
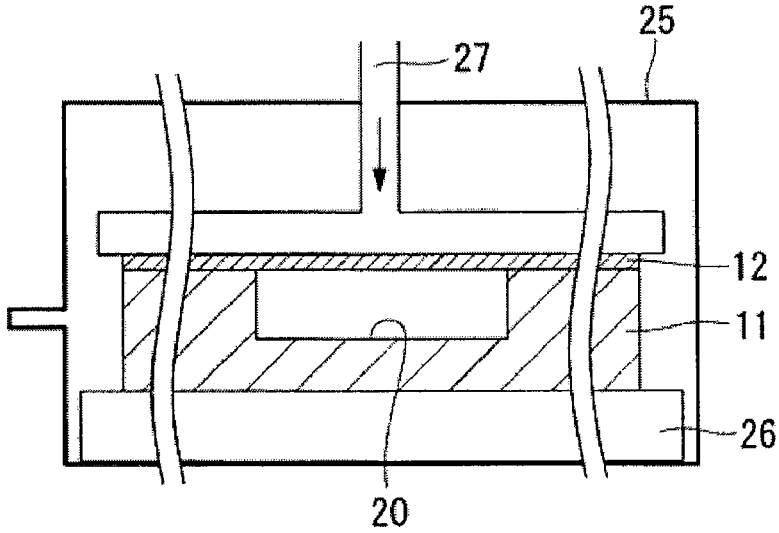
Figure 12C:
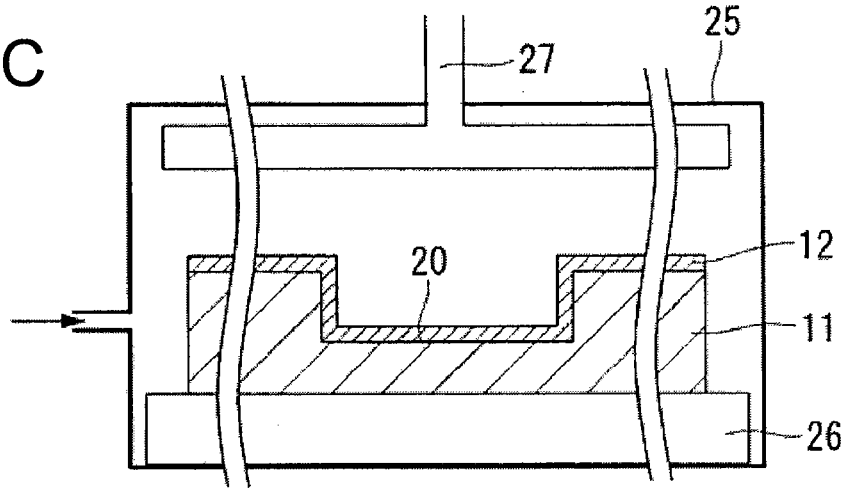

The method illustrated in FIG. 12 includes overlaying (coating) the sheet-like adhesive layer 12 having a constant thickness on the one surface of the substrate 11 (see FIG. 4) in which the concave portion 20 is formed as illustrated in FIG. 12A, placing the substrate 11 with the adhesive layer 12 on a pedestal 26 arranged in a vacuum device 25, producing a vacuum inside the vacuum device 25 by using a vacuum pump (not shown), pressing the one surface of the adhesive layer 12 (upper surface in FIG. 12) by using a press machine 27 as illustrated in FIG. 12B, and releasing the inside of the vacuum device 25 to be atmospheric pressure as illustrated in FIG. 12C, and hence the entire of the one surface of the substrate 11 is covered with the adhesive layer 12.

Figure 13:
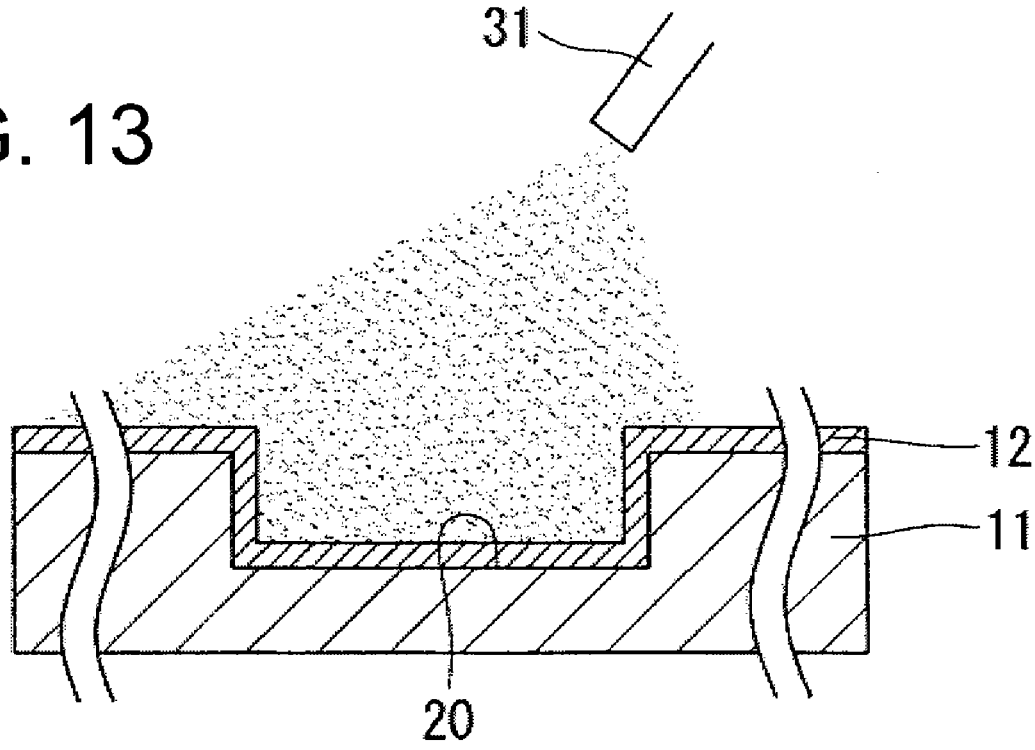
FIG. 13 is a process diagram for illustrating the manufacturing method for the thermal head according to the first embodiment of the present invention.

The method illustrated in FIG. 13 includes applying the adhesive layer material atomized by a spray 31 onto the one surface of the substrate 11 (see FIG. 4) in which the concave portion 20 is formed, and hence the entire of the one surface of the substrate 11 is covered with the adhesive layer 12.

Figure 14A:
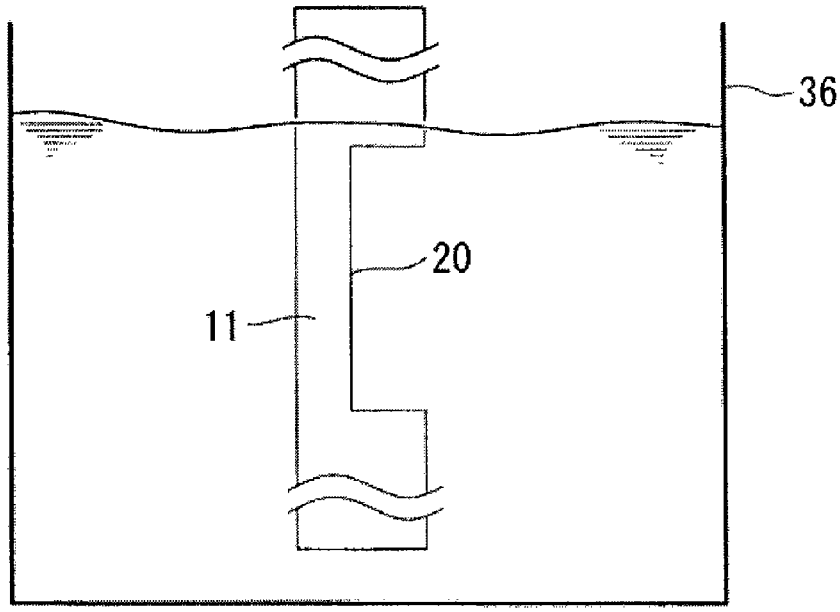
FIGS. 14A and 14B are process diagrams for illustrating the manufacturing method for the thermal head according to the first embodiment of the present invention.
Figure 14B:
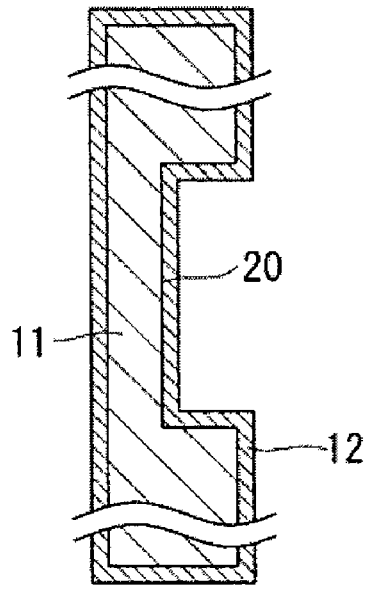

The method illustrated in FIG. 14 includes dipping (immersing) the substrate 11 (see FIG. 4) in which the concave portion 20 is formed in the liquid-like adhesive layer material filled in a container 36 as illustrated in FIG. 14A, and lifting up the same so that the entire surface of the substrate 11 is covered with the adhesive layer 12 as illustrated in FIG. 14B.

Figure 15:
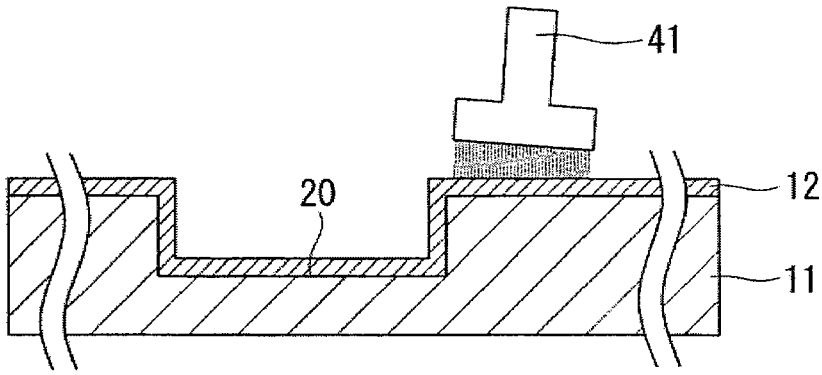
FIG. 15 is a process diagram for illustrating the manufacturing method for the thermal head according to the first embodiment of the present invention.

The method illustrated in FIG. 15 includes applying the liquid-like adhesive layer material onto the entire of the one surface of the substrate 11 (see FIG. 4) in which the concave portion 20 is formed with a brush 41, and hence the entire of the one surface of the substrate 11 is covered with the adhesive layer 12.

Figure 16A:
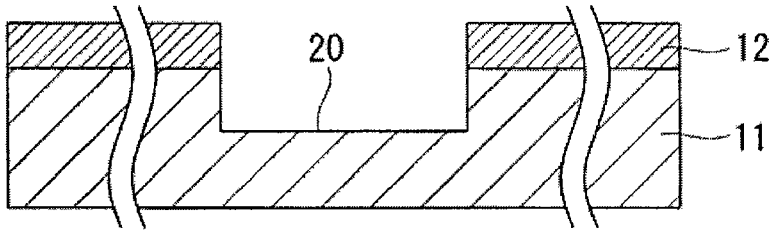
FIGS. 16A and 16B are process diagrams for illustrating the manufacturing method for the thermal head according to the first embodiment of the present invention.
Figure 16B:
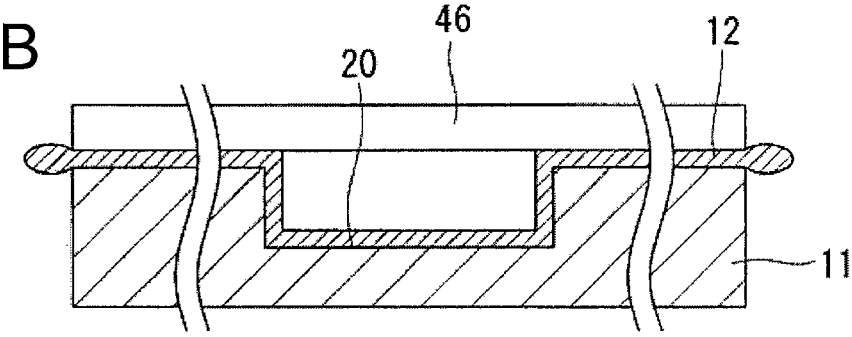

The method illustrated in FIGS. 16A and 16B includes applying the liquid-like adhesive layer 12 onto the one surface of the substrate 11 (see FIG. 4) in which the concave portion 20 is formed, at a region other than the region in which the concave portion 20 is formed with the brush 41 (see FIG. 15) or the like so that the thickness of the adhesive layer 12 becomes larger than that in the method illustrated in FIG. 15, and then pressing the one surface of the adhesive layer 12 (upper surface in FIG. 16) with a press machine 46 so that the entire of the one surface of the substrate 11 is covered with the adhesive layer 12 as illustrated in FIG. 16B.

Figure 17:
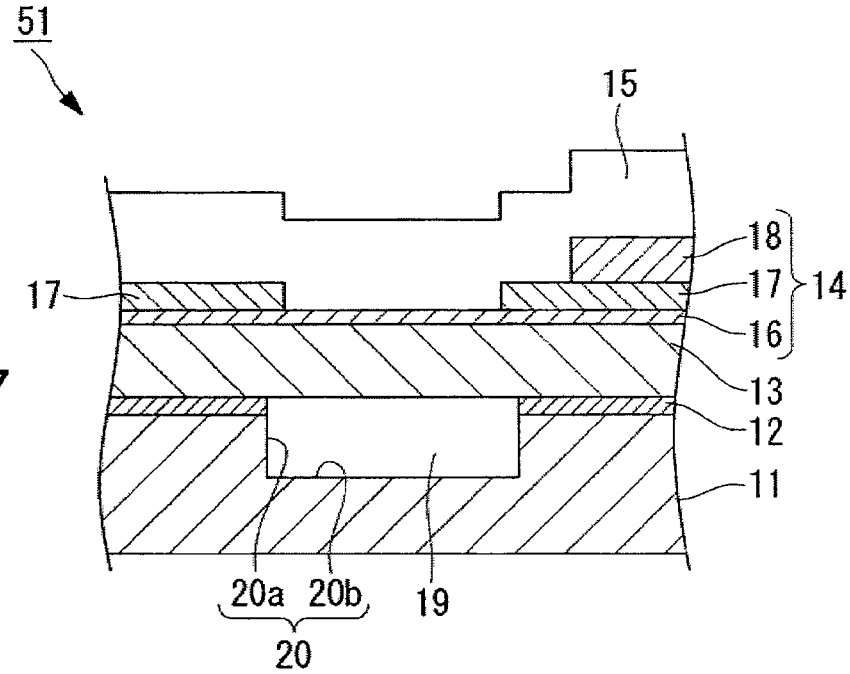
FIG. 17 is a cross sectional view of a thermal head according to a second embodiment of the present invention, which is similar to FIG. 3.

A second embodiment of a thermal head according to the present invention is described with reference to FIG. 17. FIG. 17 is a cross sectional view of the thermal head according to the present embodiment, which is similar to FIG. 3.

As illustrated in FIG. 17, the thermal head 51 according to the present embodiment is different from that of the first embodiment described above in that the adhesive layer 12 is not laminated (formed) on the wall surface 20*a* of the concave portion 20 (surface perpendicular to the one surface of the substrate 11 and the another surface of the heat storage layer 13) and on the bottom surface 20*b* (surface parallel with the one surface of the substrate 11 and the another surface of the heat storage layer 13).

Other components are the same as those of the first embodiment described above, so description of the components is omitted here.

According to the thermal head 51 of the present embodiment, the adhesive layer 12 is not laminated (formed) on the wall surface 20*a* and the bottom surface 20*b* of the concave portion 20. In other words, the adhesive layer 12 is laminated (formed) at a region other than the region at which the concave portion 20 is formed on the one surface of the substrate 11 on which the concave portion 20 is formed. Therefore, heat dissipation via the adhesive layer 12 can be suppressed, and hence the heat generating efficiency can be further improved.

Note that, the coefficient of thermal conductivity of glass is 0.9 W/mK, the coefficient of thermal conductivity of air is 0.02 W/mK, and the coefficient of thermal conductivity of an epoxy resin is 0.21 W/mK.

In addition, the thermal expansion difference that occurs between the substrate 11 and the heat storage layer 13 because of the temperature of the heating resistors 14 that rises up to approximately 200 to 300 degrees centigrade when the thermal head 51 is energized is absorbed by elastic deformation of the adhesive layer 12 made of an elastic material. Therefore, a warpage or a distortion of the thermal head 51 is eliminated (or reduced) when the thermal head 51 is energized, and hence the print quality can be maintained to be always in an optimal condition.

Further, even if a monocrystal silicon substrate is adopted as a material of the substrate 11, soda glass that is inexpensive and has good workability can be adopted as a material of the heat storage layer 13. Therefore, manufacturing cost can be reduced and manufacturing steps can be simplified.

Still further, beneath the region covered with a heat generating portion of each of the plurality of heating resistors 14 (region covered with the heat generating portion), there is formed the cavity section 19 having a sufficient height (depth) for improving the heat generating efficiency, that is, a heat insulating layer for restricting heat flowing into the substrate 11 from the heat storage layer 13. Therefore, the heat generating efficiency can be improved.

In addition, according to the thermal printer 1 provided with the thermal head 51 of the present embodiment, printing on the thermal recording paper 5 can be performed with small electric power because the thermal head 51 having high heat generating efficiency is provided. Therefore, duration time of a battery can be lengthened.

On the other hand, according to a manufacturing method for the thermal head 51 of the present embodiment, the adhesive layer 12 is not laminated (formed) on the wall surface 20*a* and the bottom surface 20*b* of the concave portion 20. In other words, the adhesive layer 12 is laminated (formed) at a region other than the region at which the concave portion 20 is formed on the one surface of the substrate 11 on which the concave portion 20 is formed. Therefore, heat dissipation via the adhesive layer 12 can be suppressed, and hence the heat generating efficiency can be further improved.

In addition, even if a monocrystal silicon substrate is adopted as a material of the substrate 11, soda glass that is inexpensive and has good workability can be adopted as a material of the heat storage layer 13. Therefore, manufacturing cost can be reduced and manufacturing steps can be simplified.

Further, beneath the region covered with a heat generating portion of each of the plurality of heating resistors 14 (region covered with the heat generating portion), there is formed the cavity section 19 having a sufficient depth for improving the heat generating efficiency, that is, a heat insulating layer for restricting heat flowing into the substrate 11 from the heat storage layer 13. Therefore, the heat generating efficiency can be improved.

Figure 18:
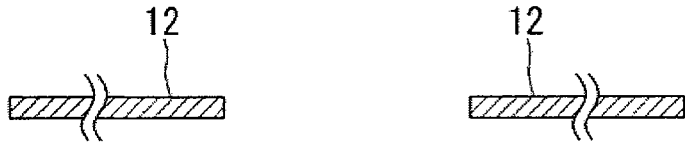
FIG. 18 is a process diagram for illustrating a manufacturing method for the thermal head according to the second embodiment of the present invention.
Figure 19:
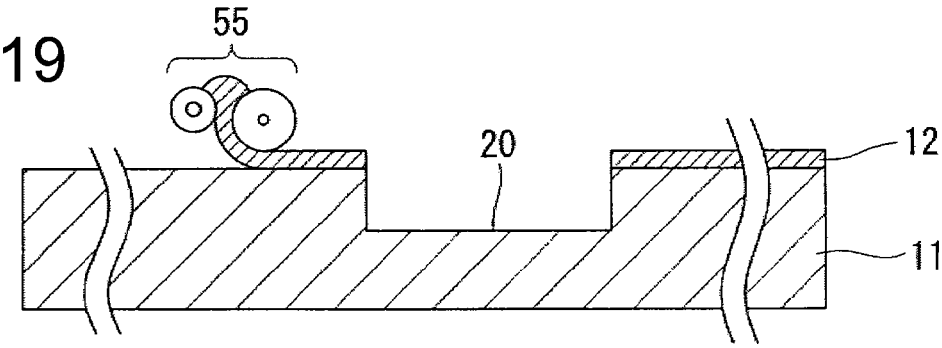
FIG. 19 is a process diagram for illustrating the manufacturing method for the thermal head according to the second embodiment of the present invention.

Note that, the adhesive layer 12 can be laminated at the region other than the region at which the concave portion 20 is formed on the one surface of the substrate 11 on which the concave portion 20 is formed by adopting the method as illustrated in FIGS. 18 and 19, for example.

The method illustrated in FIG. 18 includes hollowing the region opposed to the heat generating portion of each of the plurality of the heating resistors 14 (region covered with the heat generating portion) with machining process, laser process, punching process, or the like in advance in the sheet-like adhesive layer 12 (see FIG. 18) having a constant thickness (approximately 10 to 100 μm), and overlaying the adhesive layer 12 on the one surface of the substrate 11 (see FIG. 4) in which the concave portion 20 is formed while aligning the adhesive layer 12, and hence a region other than the region at which the concave portion 20 is formed is covered with the adhesive layer 12 on the one surface of the substrate 11 in which the concave portion 20 is formed.

The method illustrated in FIG. 19 includes applying the liquid-like adhesive layer material on the one surface of the substrate 11 (see FIG. 4) in which the concave portion 20 is formed with a roll coater 55 so that a region other than the region at which the concave portion 20 is formed is covered with the adhesive layer 12 on the one surface of the substrate 11 in which the concave portion 20 is formed.

Figure 20:
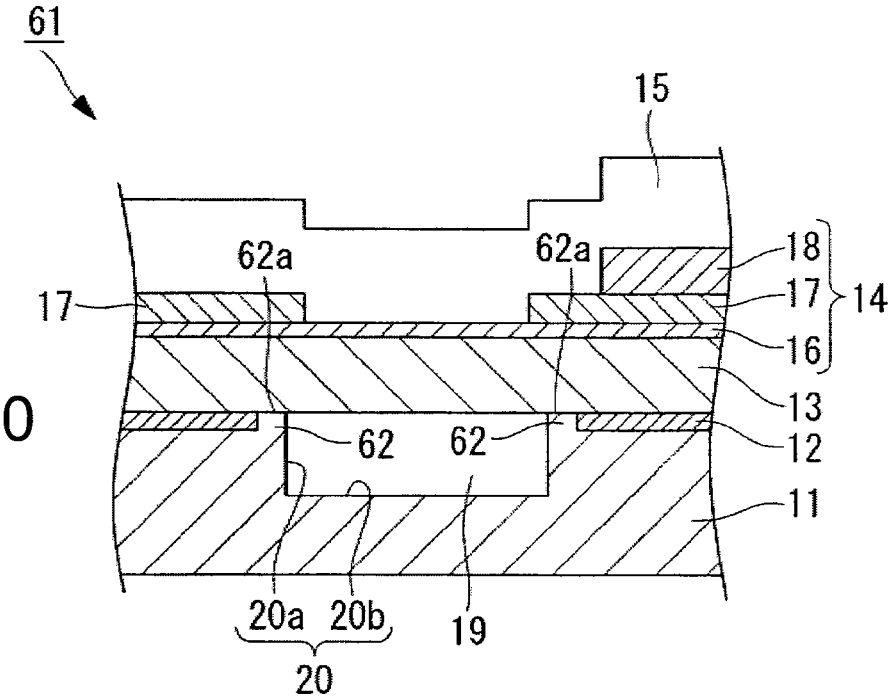
FIG. 20 is a cross sectional view of a thermal head according to a third embodiment of the present invention, which is similar to FIG. 3.

A third embodiment of a thermal head according to the present invention is described with reference to FIG. 20. FIG. 20 is a cross sectional view of the thermal head according to the present embodiment, which is similar to FIG. 3.

As illustrated in FIG. 20, the thermal head 61 according to the present embodiment is different from that of the second embodiment described above in that a dam 62 is formed along the wall surface 20*a* of the concave portion 20, that is, along the contour of the concave portion 20 in the plan view.

Other components are the same as the second embodiment described above, so description of the components is omitted here.

According to the thermal head 61 of the present embodiment, the adhesive layer 12 is formed uniformly (evenly) to have a thickness that is the same as the height of the dam 62. Therefore, unevenness (variation) of thermal efficiency due to variation (difference) of thickness of the adhesive layer 12 can be eliminated, and hence the print quality can be further improved.

In addition, a tip surface 62*a* of the dam 62 protruding from the one surface of the substrate 11 toward the another surface of the heat storage layer 13 supports the pressing force exerted by the surface of the heating resistor 14 (upper surface in FIG. 20). Therefore, mechanical strength against an excessive pressure when the printing is performed can be improved, and hence durability and reliability can be improved.

Note that, in the present embodiment, the adhesive layer 12 does not exist between the tip surface 62*a* of the dam 62 and the another surface of the heat storage layer 13, and hence the substrate 11 can be thermally expanded (moved) with respect to the heat storage layer 13, or the heat storage layer 13 can be thermally expanded (moved) with respect to the substrate 11.

According to the thermal head 61 of the present embodiment, the thermal expansion difference that occurs between the substrate 11 and the heat storage layer 13 because of the temperature of the heating resistors 14 that rises up to approximately 200 to 300 degrees centigrade when the thermal head 61 is energized is absorbed by elastic deformation of the adhesive layer 12 made of an elastic material. Therefore, a warpage or a distortion of the thermal head 61 is eliminated (or reduced) when the thermal head 61 is energized, and hence the print quality can be maintained to be always in an optimal condition.

In addition, even if a monocrystal silicon substrate is adopted as a material of the substrate 11, soda glass that is inexpensive and has good workability can be adopted as a material of the heat storage layer 13. Therefore, manufacturing cost can be reduced and manufacturing steps can be simplified.

Further, beneath the region covered with a heat generating portion of each of the plurality of heating resistors 14 (region covered with the heat generating portion), there is formed the cavity section 19 having a sufficient height (depth) for improving the heat generating efficiency, that is, a heat insulating layer for restricting heat flowing into the substrate 11 from the heat storage layer 13. Therefore, the heat generating efficiency can be improved.

In addition, according to the thermal printer 1 provided with the thermal head 61 of the present embodiment, printing on the thermal recording paper 5 can be performed with small electric power because the thermal head 61 having high heat generating efficiency is provided. Therefore, duration time of a battery can be lengthened.

On the other hand, according to a manufacturing method for the thermal head 61 of the present embodiment, the adhesive layer 12 that is apt to flow into the cavity section 19 from between the tip surface 62*a* of the dam 62 and the another surface of the heat storage layer 13 is blocked by the dam 62. Therefore, the adhesive layer 12 is prevented from adhering to the portion between the tip surface 62*a* of the dam 62 and the another surface of the heat storage layer 13, or to the wall surface 20*a* or the bottom surface 20*b* of the concave portion 20. Thus, heat dissipation via the adhesive layer 12 can be suppressed, and hence the heat generating efficiency can be further improved.

In addition, even if a monocrystal silicon substrate is adopted as a material of the substrate 11, soda glass that is inexpensive and has good workability can be adopted as a material of the heat storage layer 13. Therefore, manufacturing cost can be reduced and manufacturing steps can be simplified.

Further, beneath the region covered with a heat generating portion of each of the plurality of heating resistors 14 (region covered with the heat generating portion), there is formed the cavity section 19 having a sufficient height (depth) for improving the heat generating efficiency, that is, a heat insulating layer for restricting heat flowing into the substrate 11 from the heat storage layer 13. Therefore, the heat generating efficiency can be improved.

Figure 21:
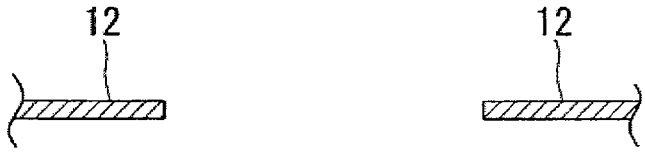
FIG. 21 is a process diagram for illustrating a manufacturing method for the thermal head according to the third embodiment of the present invention.
Figure 22:
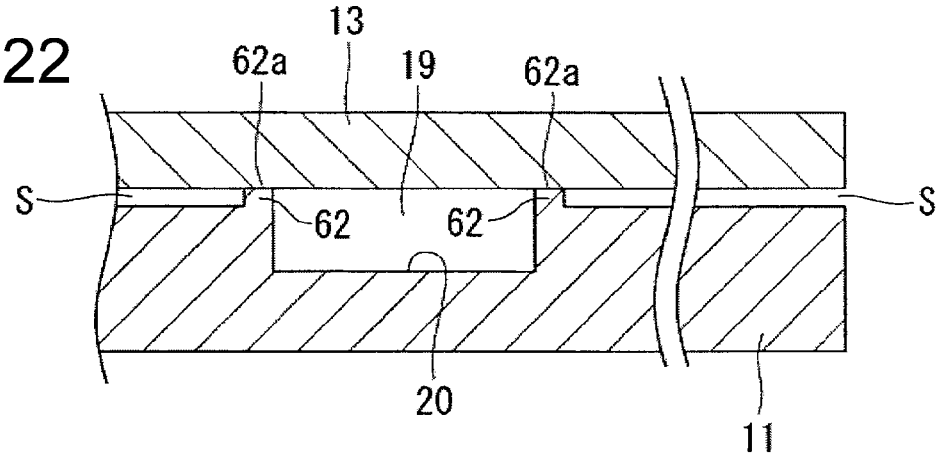
FIG. 22 is a process diagram for illustrating a manufacturing method for the thermal head according to the third embodiment of the present invention.
Figure 23:
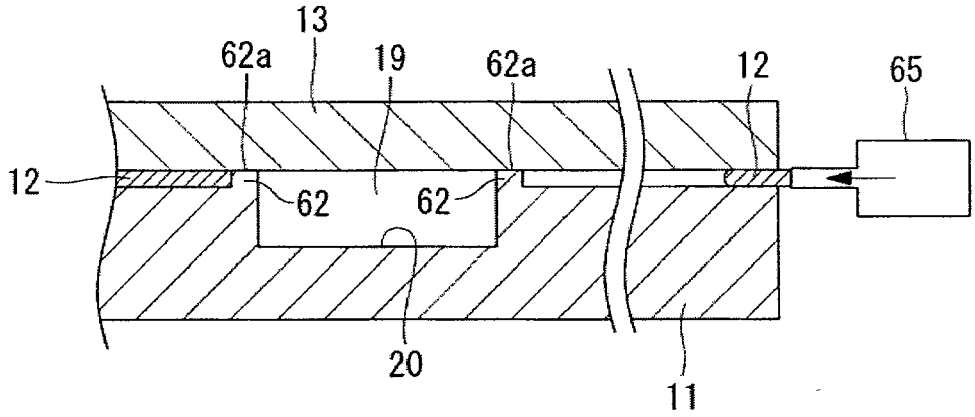
FIG. 23 is a process diagram for illustrating a manufacturing method for the thermal head according to the third embodiment of the present invention.

Note that, the adhesive layer 12 can be laminated at a region other than the region at which the concave portion 20 and the dam 62 are formed on the one surface of the substrate 11 on which the concave portion 20 is formed by adopting the method as illustrated in FIGS. 21 to 23, for example.

The method illustrated in FIG. 21 includes hollowing the region corresponding to the concave portion 20 and the dam 62 (region opposed to the heat generating portion) with machining process, laser process, punching process, or the like in advance in the sheet-like adhesive layer 12 (see FIG. 21) having a constant thickness (approximately 10 to 100 μm), and overlaying the adhesive layer 12 on the one surface of the substrate 11 (see FIG. 20) in which the concave portion 20 and the dam 62 are formed while aligning the adhesive layer 12, and hence a region other than the region at which the concave portion 20 and the dam 62 are formed is covered with the adhesive layer 12 on the one surface of the substrate 11 in which the concave portion 20 and the dam 62 are formed.

The method illustrated in FIGS. 22 and 23 includes overlaying the heat storage layer 13 on the substrate 11 so that the another surface of the heat storage layer 13 abuts the tip surface 62*a* of the dam 62 (see FIG. 22), and injecting the liquid-like adhesive layer 12 with an injector 65 or the like into a space (gap) S formed between the tip surface 62*a* of the dam 62 and the another surface of the heat storage layer 13 at a region other than the region at which the concave portion 20 and the dam 62 are formed, and hence the region other than the region at which the concave portion 20 and the dam 62 are formed is covered with the adhesive layer 12 on the one surface of the substrate 11 in which the concave portion 20 and the dam 62 are formed.

Note that, the thermal head of the present invention is not limited to the embodiments described above, which can be appropriately modified, changed and combined depending on necessities.

For instance, the same numbers of the cavity portions 19 are formed as the heating resistors 14 in the embodiments described above, but the present invention is not limited to this structure. The cavity portions 19 may be formed to be connected over the heating resistors 14 along the arrangement direction of the heating resistors 14, so as to constitute one cavity portion.

According to the thermal head having the above-mentioned cavity portions, neighboring cavity portions are communicated to each other, and a part of an outflow path for heat (heat quantity) generated in the heating resistor 14 to the inside of the substrate 11 is blocked. Therefore, flowing out of the heat (heat quantity) generated in the heating resistor 14 to the inside of the substrate 11 can be further suppressed, heat generating efficiency of the heating resistor 14 can be further improved, and electric power consumption can be further reduced.

Figure 24:
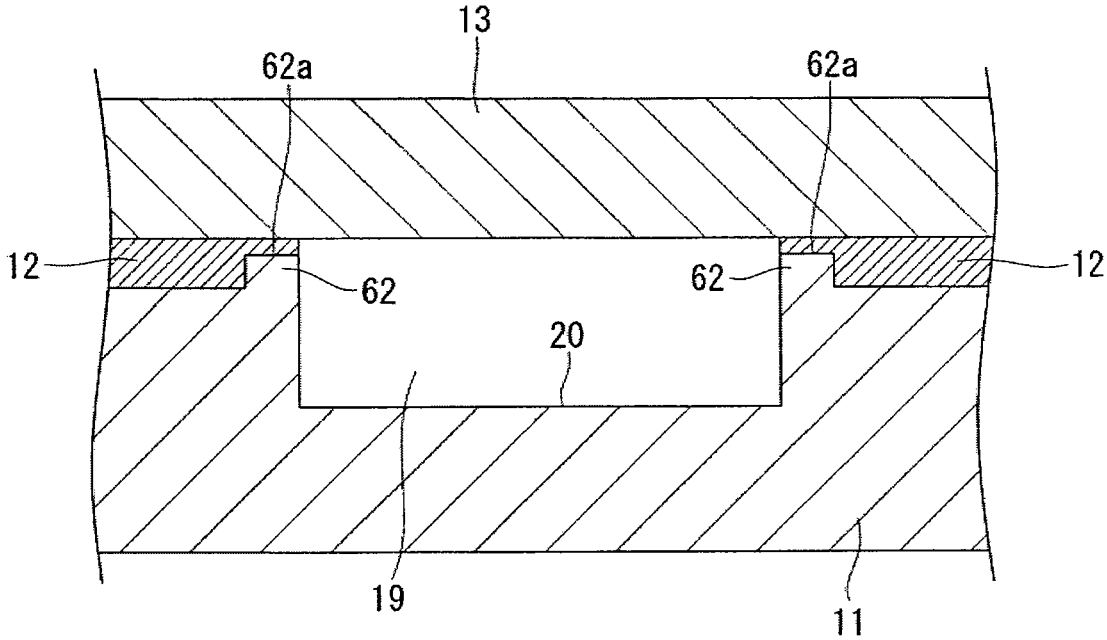
FIG. 24 is a cross sectional view of a main part of a thermal head according to another embodiment of the present invention.

In addition, the above-mentioned third embodiment describes the case where the adhesive layer 12 does not exist between the tip surface 62*a* of the dam 62 and the another surface of the heat storage layer 13. However, as illustrated in FIG. 24, it may be possible to adopt the structure and manufacture in which the adhesive layer 12 exists between the tip surface 62*a* of the dam 62 and the another surface of the heat storage layer 13.

Further, the above embodiments describe the thermal head 4 and the thermal printer 1 that directly develops color by heat, but the present invention is not limited to this structure. The present invention can also be applied to a heating resistance element other than the thermal head 4 or to a printer device other than the thermal printer 1.

For instance, the present invention can be applied to a heating resistance element component such as a thermal type inkjet head for jetting ink by heat or a valve type inkjet head. In addition, the present invention can also be applied to other electronic components having a film heating resistance element component such as a thermal erase head having a substantially similar structure to that of the thermal head, a fixing heater for a printer, or the like that needs thermal fixing, or a thin film heating resistance element of a light guide type optical component, and hence similar effects can be obtained.

In addition, the present invention can be applied to a printer such as a thermal transfer printer using a sublimation type or a melting type transfer ribbon, a rewritable thermal printer capable of developing color and discharging of a print medium, or a heat-sensitive adhesive activating label printer, the adhesive exhibiting thermal adhesiveness.

What is claimed is:

1. A thermal head comprising:

a supporting substrate;

a heat storage layer laminated on a surface of the supporting substrate via an adhesive layer made of an elastic material; and a plurality of heating resistors arranged with spaces therebetween on the heat storage layer, wherein:

a cavity section is formed at a region between the supporting substrate and the heat storage layer, the region being opposed to a heat generating portion of each of the plurality of heating resistors; and the cavity section comprises a concave portion formed in the surface of the supporting substrate and the heat storage layer in which the concave portion is closed and the surface thereof is exposed to the cavity section, wherein a wall surface and a bottom surface which constitute the concave portion are exposed to the cavity section, wherein a dam formed along the wall surface of the concave portion on the surface of the supporting substrate, and the adhesive layer is arranged outside the dam.

2. A thermal printer provided with the thermal head according to claim 1.

3. A manufacturing method for a thermal head, comprising:

forming a concave portion in a surface of a supporting substrate;

forming a dam along a wall of the concave portion on the surface of the supporting substrate;

laminating an adhesive layer made of an elastic material outside the dam on the surface of the supporting substrate, in which the concave portion is formed;

bonding a heat storage layer in a laminated state with respect to the surface of the supporting substrate via the adhesive layer; and forming a plurality of heating resistors with spaces therebetween at a region corresponding to a surface of the heat storage layer, the region being opposed to the concave portion.

4. A manufacturing method for a thermal head according to claim 3, wherein the laminating an adhesive layer comprises laminating an adhesive layer material formed in a flat sheet-like shape on the surface of the supporting substrate, and then deforming the adhesive layer material by one of heat and external force so as to conform to a shape of the surface of the supporting substrate, in which the concave portion is formed.

5. A manufacturing method for a thermal head according to claim 3, wherein the laminating an adhesive layer comprises laminating the adhesive layer at a region other than the concave portion on the surface of the supporting substrate, in which the concave portion is formed.

6. A manufacturing method for a thermal head comprising:

forming a concave portion and a dam surrounding the concave portion on a surface of a supporting substrate;

laminating an adhesive layer made of an elastic material at a region outside the dam on the supporting substrate in which the concave portion and the dam are formed;

bonding a heat storage layer in a laminated state with respect to the surface of the supporting substrate via the adhesive layer; and forming a plurality of heating resistors with spaces therebetween at a region corresponding to a surface of the heat storage layer, the region being opposed to the concave portion.

7. A manufacturing method for a thermal head comprising:

forming a concave portion and a dam surrounding the concave portion on a surface of a supporting substrate;

laminating a heat storage layer on the surface of the supporting substrate in which the concave portion and the dam are formed, injecting an adhesive layer material made of an elastic material into a gap formed between the heat storage layer and the supporting substrate by the dam; and bonding the supporting substrate and the heat storage layer to each other.

* * * * *